United States Patent [19]

Basham

[11] 4,262,773

[45] Apr. 21, 1981

[54] PORTABLE SCAFFOLD

[76] Inventor: Billy G. Basham, Rte. 2, Paducah, Ky. 42001

[21] Appl. No.: 57,492

[22] Filed: Jul. 13, 1979

[51] Int. Cl.[3] ..... E04G 1/18

[52] U.S. Cl. ..... 182/132; 182/145; 182/178; 187/9 R

[58] Field of Search ..... 182/145, 146, 132, 131, 182/130, 178, 129; 187/2, 9 R, 11

[56] References Cited

U.S. PATENT DOCUMENTS

| | | | |
|---|---|---|---|
| 1,393,932 | 10/1921 | Andre | 182/132 |
| 1,715,200 | 5/1929 | Lambert | 182/145 |
| 2,803,503 | 8/1957 | Borgman | 182/132 |
| 2,997,126 | 8/1961 | Morgen | 182/178 |
| 3,016,989 | 1/1962 | Lindmark | 182/129 |
| 3,169,604 | 2/1965 | Dranger | 182/132 |

*Primary Examiner*—Reinaldo P. Machado

*Attorney, Agent, or Firm*—Lowe, King, Price & Becker

[57] ABSTRACT

A self-contained scaffold and lift unit includes first and second pairs of parallel, spaced apart vertical rails joined together by horizontal braces. A movable lifting carriage unit is disposed between the pairs of vertical rails and includes pairs of rollers engaging and captured between the pairs of vertical rails to provide smooth vertical motion with respect to the rails. A primary load-bearing platform is removably attached to a lower portion of the carriage unit and an auxiliary load-bearing platform is removably attached to an upper portion of the carriage unit. A manually driven hoist is attached to the carriage to allow controlled movement. The carriage unit is positioned with respect to the rails by the hoist. An auxiliary base assembly is removably mounted to the scaffold unit to secure the scaffold unit in an erect and freestanding manner. The rigid scaffold units are assembled in modular interfitting sections to allow a scaffold of any desired height to be formed.

10 Claims, 9 Drawing Figures

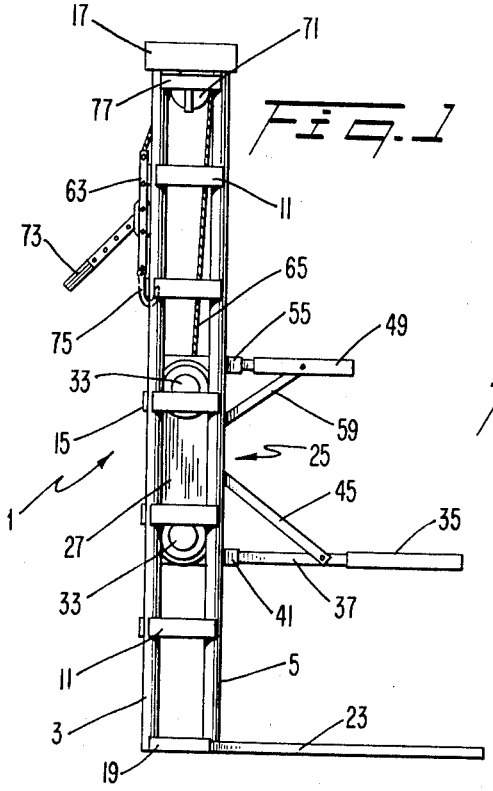
Fig. 1
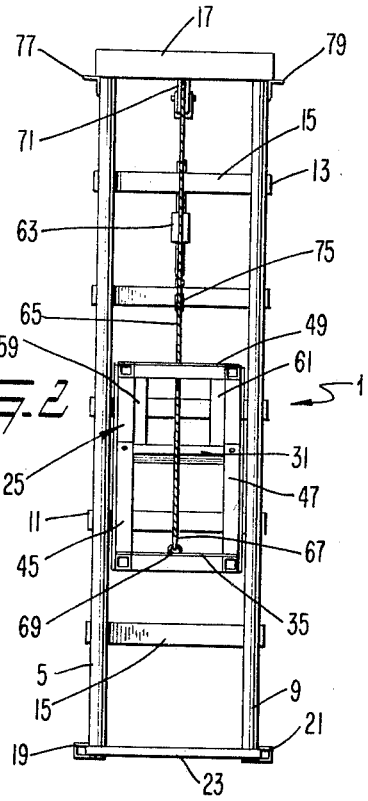
Fig. 2
Fig. 3
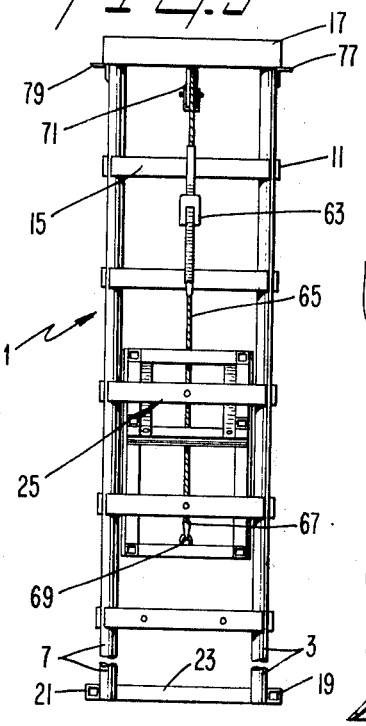
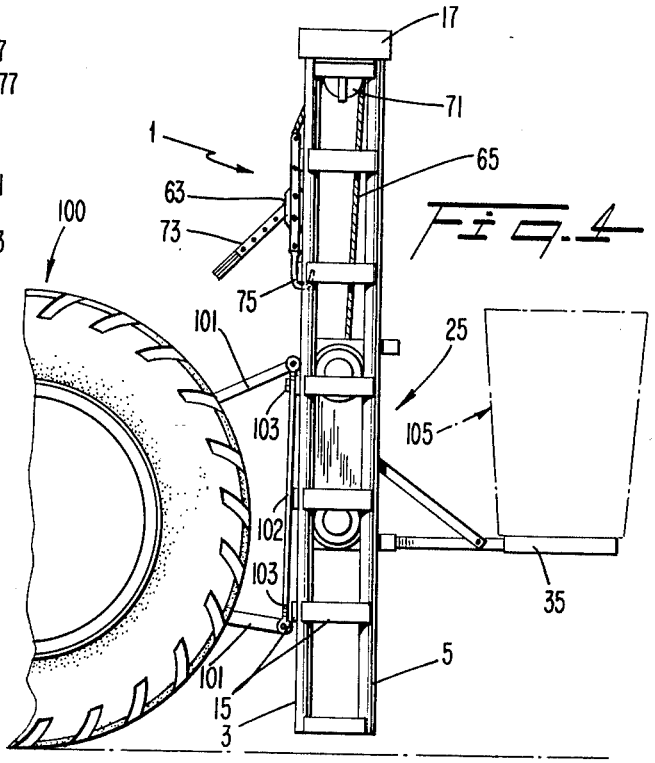
Fig. 4

PORTABLE SCAFFOLD

BACKGROUND OF THE INVENTION

The invention relates to the field of scaffolds and more particularly to a rigid, portable scaffold unit which includes an adjustable carriage to support one or more platforms.

DESCRIPTION OF THE PRIOR ART

Scaffolding of various types has been used over the years in the construction trades. Generally, scaffolds are formed from pipe or other rigid materials and assembled together, piece-by-piece, at the job site. Such scaffolds may include an adjustable platform for supporting construction materials or workmen at a desired height.

However, prior art scaffold units suffer from the disadvantages of being rather large in size and bulky, and requiring time consuming hand assembly. Such scaffolds are not rigid and can collapse if improperly assembled. Because of their large size and weight, prior art scaffolds are ill-suited for use at small construction sites or for general use around the home or farm, where probability is an advantage. Such scaffolds are expensive to purchase, thus reducing their desirability with homeowners or small tradesmen.

OBJECTS OF THE INVENTION

It is therefore an object of the invention to provide a rigid, relataively light-weight and portable scaffold and platform-type lift assembly.

It is an additional object to provides a self-contained scaffold and lift assembly which is inexpensive and easy to manufacture.

If is a further object to provide scaffold and lift assembly which is modular so that scaffolding of any desired height can be formed.

It is still another object to provide a scaffold and lift assembly which is free-standing.

It is yet a further object to provide a scaffold and platform-type lift assembly in which the height of the platform is readily adjustable to any height.

SUMMARY OF THE INVENTION

These and other object are achieved by the present invention wherein there is provided a self-contained scaffold and platform-type lift unit which includes first and second pairs of parallel, space apart vertical rails joined together by horizontal braces. A movable lifting carriage unit is disposed between the pairs of vertical rails and includes pairs of rollers captured between and engaging the vertical rails to provide smooth vertical motion of the carriage unit with respect to the rails. A primary load-bearing platform is removably attached to a lower portion of the carriage and an auxiliary load-bearing platform is removably attached to an upper portion. A hoist unit is connected to the carriage to allow controlled movement with respect to the vertical rails. The carriage unit is secured at a desired position along the rails by a suitable brake in the hoist unit. An auxiliary base assembly is removable mounted to the scaffold unit to secure the scaffold unit in an erect (vertcal) and free-standing position with respect to the ground or other horizontal surface. The scaffold unit is formed having modular interfitting rail sections to allow a scaffolding of any desired height to be formed.

The self-contained scaffold and lift assembly of the present invention is desirably light in weight and portable, thus making it useful to the tradesman, farmer or homeowner who desires a device for lifting and supporting himself or other objects at a desired height. The scaffolding is preassembled in modular units, thus ensuring adequate rigidity for the resulting scaffolding. The scaffolding can be quickly set up or taken down at a particular job site with a minimum of manual assembly. One or more scaffold units can be used to support heavy loads. The movable carriage unit is readily adjusted in height by the hoist unit which can be operated either from the ground or by a workman standing on the primary load-bearing platform. The auxiliary base assembly enables the scaffolding to be erected in a free-standing manner without the need for auxiliary bracing or guying.

BRIEF DESCRIPTION OF THE DRAWING FIGURES

These and other features and advantages of the invention are pesented in the following detailed description of the preferred embodiment, taken in conjunction with the accompanying drawing figures, wherein:

FIG. 1 is a left side elevational view of the scaffold and lift assembly of the present invention;

FIG. 2 is a front elevational view of the scaffold and lift assembly of FIG. 1;

FIG. 3 is a rear elevational view of the scaffold and lift assembly of FIG. 1;

FIG. 4 is a left side elevational view of the scaffold and lift assembly shown attached to the rear of a vehicle, such as a tractor;

FIG. 8 is a partial left side elevational view of the scaffold and lift assembly shown attached by an auxiliary bracket to the rear of a truck or the like.

DESCRIPTION OF THE PREFERRED EMBODIMENT

Figure 6:
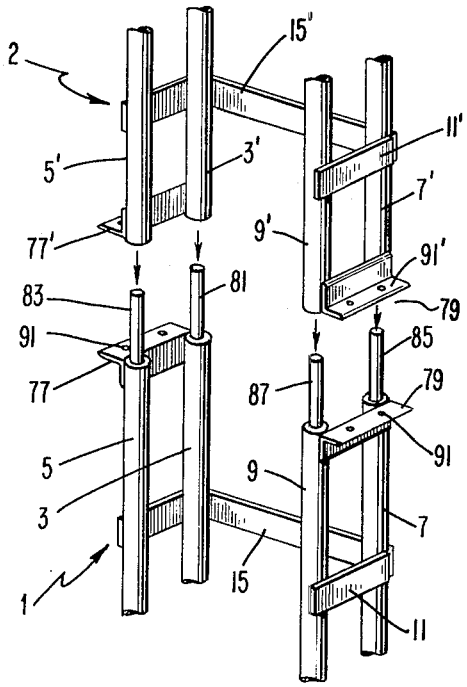
FIG. 6 is a detailed perspective view of the interlocking arrangement between two modular scaffold sections.

A scaffold unit 1 shown in FIGS. 1, 2 and 3 includes a pair of left-side vertical support member 3 and 5, and an identical pair of right-side vertical support members 7 and 9 (with rearmost right-hand support member 7 shown clearly in FIG. 6). Support members 3, 5 and 7, 9 preferably comprise rails formed from heavy guage steel tubing, or the like, having a circular cross-section.

Left-side vertical support members 3 and 5 are rigidly joined to one another and held in a parallel, spaced-spart relationship by a plurality of generally horizontal braces 11 which are secured to support member 3 and 5 through welding, bolts, or other well-known fastening means. Likewise, right-side vertical support members 7 and 9 are rigidly secured in a parallel, spaced apart relationship by right-side braces 13.

The left and right-side pairs of vertical supports are secured in a parallel, spaced-part relationship to each other by horizontal real braces 15 to form a scaffold unit having a generally U-shaped horizontal cross-section, as shown in FIG. 6.

A top plate or cap member 17 is removably fitted over the uppermost portions of vertical support members 3, 5, 7 and 9. A pair of hollow channel members 19 and 21 are mounted to respective left-side and right-side vertical support members 3, 5, and 7, 9 at their bases. Hollow channel members 19 and 21 are adapted to receive complementary ends of a removable base support 23. When the complementary ends of U-shaped base support 23 are fitted into channel members 19 and 21, the scaffold unit 1 is secured in an erect and free-standing position with respect to the surface upon which it is placed.

Figure 7:
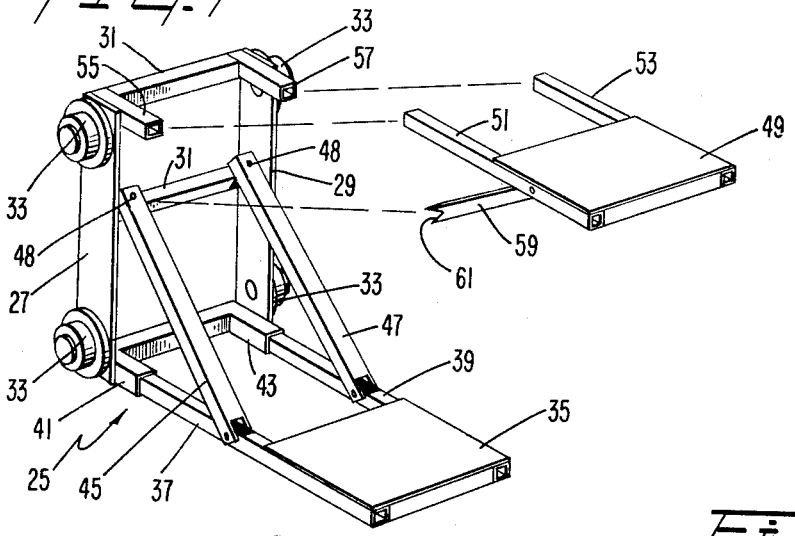
FIG 7 is a perspective view of the movable platform-type lift unit shown in FIG. 1, showing the relationship of the upper and lower load-bearing platforms to the platform unit.

A movable lift-type carriage unit 25, shown in more detail in FIG. 7, is disposed between left and right side vertical support members 3, 5 and 7, 9. Carriage 25 comprises a left-side runner 27 joined to a right-side runner 29 by one or more horizontal braces 31. Each vertical runner 27 and 29 includes a pair of roller units 33 rotatably attached thereto. Roller units 33 have a diameter sufficient to slidingly engage respective left and right-side vertical support members 3, 5 and 7, 9. The length of platform braces 31, and hence the spacing between vertical runners 27 and 29, is just sufficient to cause rollers 33 to be slidingly captured between respective left and right-side vertical support members 3, 5 and 7, 9.

A main load-bearing platform 35 is removably attached to a pair of horizontal arms 37 and 39 which slidingly interfit within respective left and right-side brackets 41 and 43. Respective left and right side angle supports 45 and 47 are connected to main platform arms 37 and 39 and attached to one of the horizontal braces 31 by bolts 48, or other suitable means such as hooks (not shown).

A removable auxiliary load-bearing platform 49 includes a pair of support arms 51 and 53 which interfit with respective left and right-side auxiliary support brackets 55 and 57. Auxiliary platform 49 also includes a pair of angle supports 59 (with only one angle support being shown in FIG. 7) which interfit with one of the horizontal platform assembly braces 31, such as by the notch 61.

Carriage unit 25 is arranged for vertical movement with respect to respective left and right-side vertical support members 3, 5 and 7, 9 by a hoist unit 63. Hoist unit 63 is attached to scaffold unit 1 (as shown in FIGS. 1–3) and includes a cable 65 having a hook 67 attached to one end thereof which engages an eye 69 connected to carriage unit 25 (see FIGS. 2 and 3). The cable 65 engages a pulley 71 attached to cap member 17.

Hoise 63 can be a manually or motor driven winch. Of course, other well-known types of hoisting means could be used. Hoist 63, as shown in the drawing figures, is a hand-lever operated ratchet-type winch of a type well-known in the art. Hoist 63 includes a lever 73 for operating the internal ratchet-type windlass mechanism (not shown). A hook 75 attached to a part of hoist 63 may engage one of the horizontal scaffold braces 15 (FIG. 1). The particular brace 15 to which hook 75 of hoist 63 is engaged depends on the length of the cable to be played out and the position of the hoist operator. Hoist positions exterior to the scaffold assembly 1 (FIG. 1) are preferred when the operator manipulates the hoist while standing on the ground or a separate support. If the operator desires to manipulate the hoist while standing on the main load-bearing platform 35, the position of hoist 63 and cable 65 can be reversed such that book 75 of hoist 63 is attached to eye 69 of the carriage assembly 25 and hook 67 of cable 65 is secured to one of the horizontal scaffold braces 15 (see FIG. 5).

Thus, the arrangement of the hoist unit allows the platform assembly to be readily moved and secured at a desired vertical height above the ground.

Figure 5:
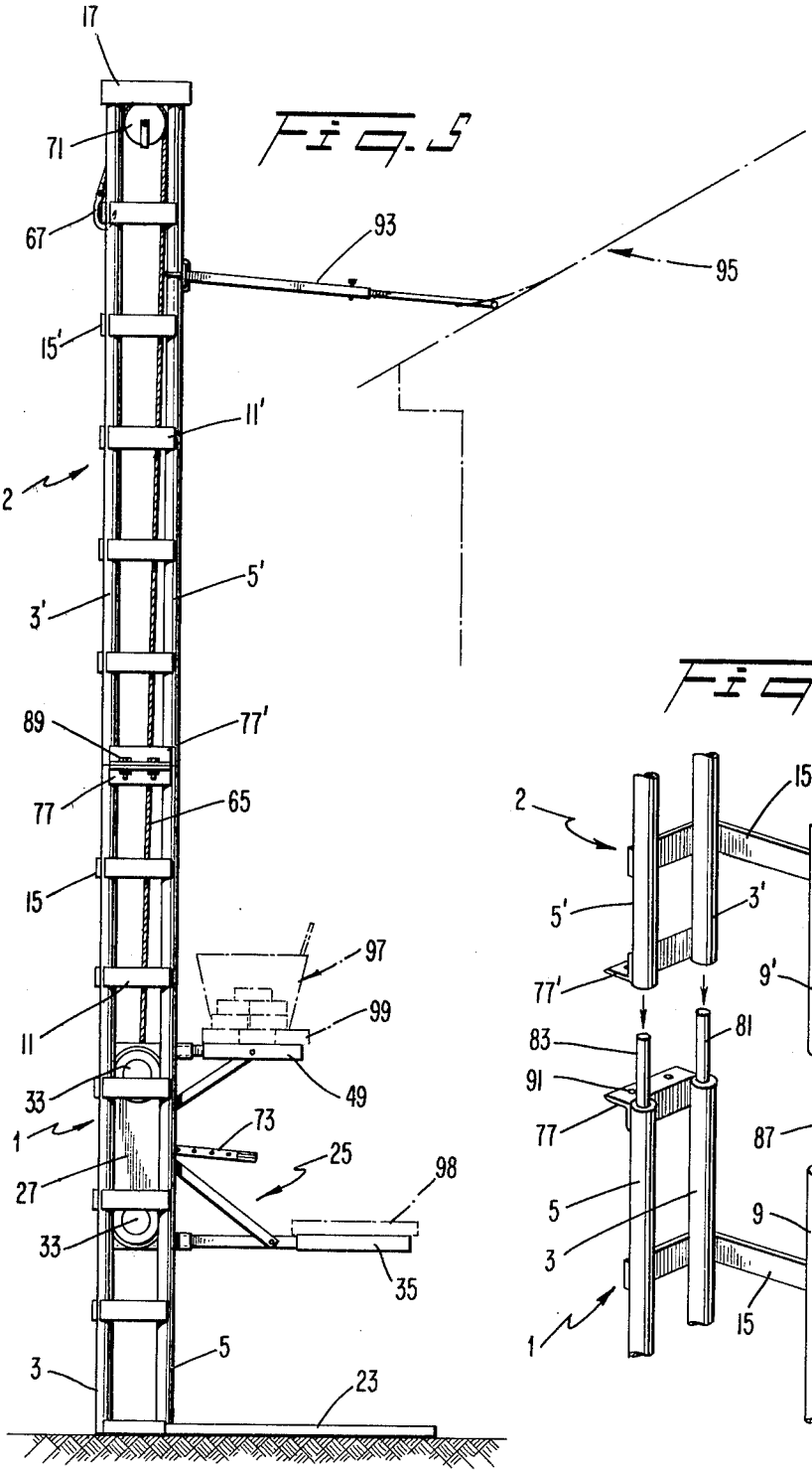
FIG. 5 is a left side elevational view of the scaffold and lift assembly showing a second modular scaffold section attached to the top of the scaffold unit shown in FIG. 1.

In FIG. 5, scaffold 1 is shown as including a second modular scaffold section 2 which interfits with lower scaffold unit 1, as shown in close-up views in FIG. 6. Vertical support members 3, 5 and 7, 9 include respective reduced portions 81, 83, and 85, 87. Reduced portions 81, 83 and 85, 87 interfit with the hollow interiors of respective tubular support members 3′, 5′ and 7′, 9′ of upper scaffold section 2.

Upper scaffold section 2 is substantially identical in construction to lower scaffold unit 1 and includes horizontal side braces 11′ and horizontal rear braces 15′. To assemble scaffold sections 1 and 2 together, cap 17 containing pulley 71 is removed from the top of the lower scaffold section 1. Cap 17 is then attached to the top of upper scaffold section 2. Upper scaffold section 2 is fitted to lower scaffold section 1, with L-shaped plates 77 and 79 of lower scaffold section 1 abutting similar L-shaped plates 77′ and 79′ of upper scaffold section 2. As shown in FIG. 5, the upper and lower scaffold sections are joined by a plurality of bolts 89 disposed through openings 91 and 91′ formed in respective lower and upper scaffold joining plates 77, 79 and 77′, 79′.

Also shown in FIG. 5 is an adjustable stand-off brace 93 which is removably attached to the scaffold unit. Brace 93 can be used, for example, to secure upper scaffold section 2 against the sloping roof of a building 95 (shown in dashed lines in FIG. 5). Brace 93 lends stability to the scaffolding unit when heavy loads such as bricks and mortar 97 (shown in dashed lines in FIG. 5) are carried on platform unit 25 near the top of the scaffolding.

When working along the face of a building for laying brick, or the like, two or more scaffolding assemblies are used together with a board or boards resting on the two platforms 35, 49 to provide a continuous walkway 98, or support surface 99, respectively.

Figure 8:
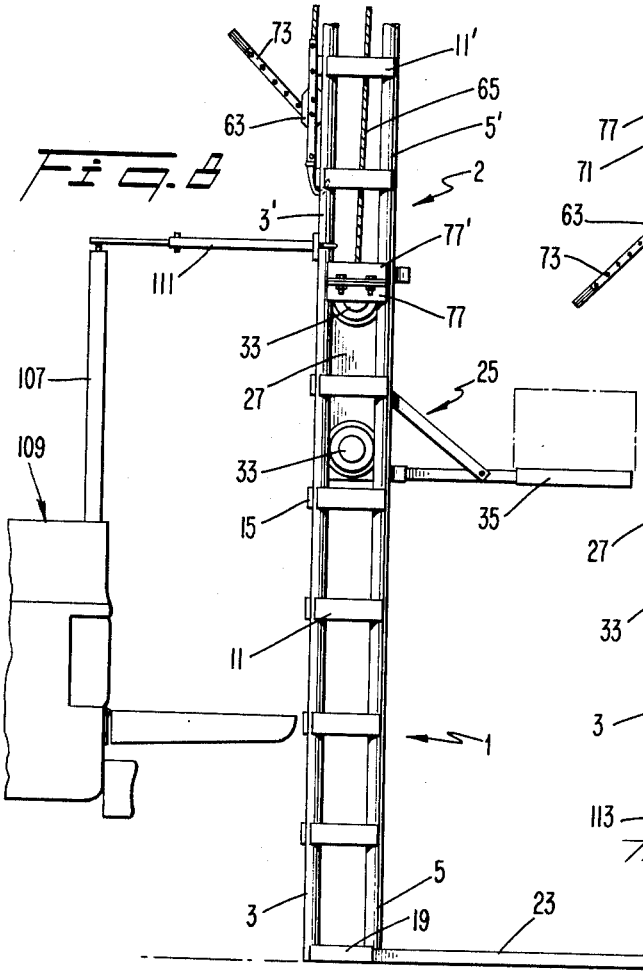
Figure 9:
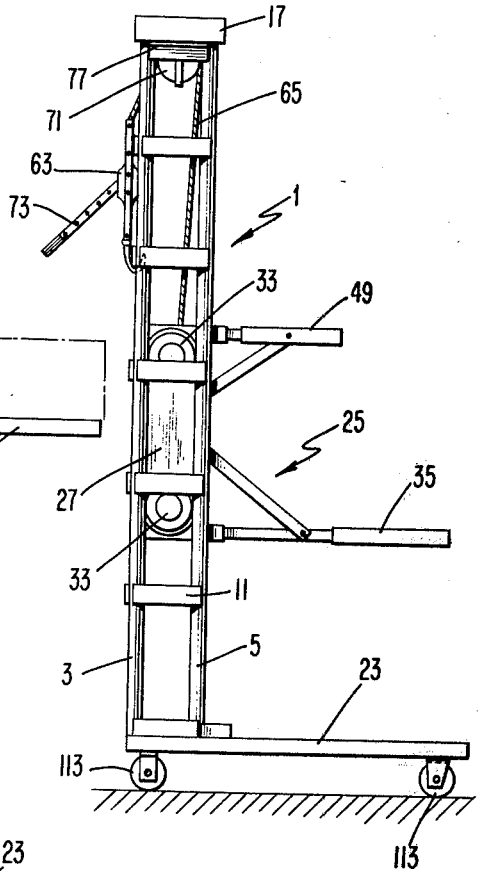
FIG. 9 is a left side elevational view of the scaffold assembly of FIG. 1 showing the use of auxiliary casters in conjunction with the removable base of the scaffold assembly.

Several auxiliary supporting and transporting devices, shown in FIGS. 4, 8 and 9, increase the versatility and portability of the scaffold and lift assembly of the present invention.

As shown in FIG. 4, scaffold unit 1 is attached to the lifting mechanism (not shown) of a tractor or other such vehicle 100 by a three-point hitch 101. Hitch 101 is attached to a vertical "Y" shaped yoke or bracket 102 which in turn is attached to horizontal rear braces 15 of scaffold unit 1 through bolts 103 or other similar fastening means. By activating the lifting mechanism of tractor 100 the operator causes the entire scaffold unit 1 including a load 105 (shown in dashed lines in FIG. 4) resting on lower platform 35, to be completely lifted off the ground. The platform 35 and the load 105 can then be finally positioned by operation of the winch 63.

In FIG. 8, scaffold units 1 and 2 are shown connected to a vertical mounting bar 107 of a pick-up truck 103 by an adjustable horizontal brace 111. Brace 111 is removably attached to one of the vertical support members of the scaffold units. With the scaffold unit so supported, it can be stabilized by truck 109.

In FIG. 9, casters or wheels 113 are shown attached to removable base member 23 of scaffold unit 1. This arrangement allows scaffold unit 1 to be readily wheeled about a job site if a hard floor, such as a concrete slab, is present. Wheels 113 may be removable from base member 23.

Thus, it can be seen that the scaffold and lift assembly of the present invention is simple in construction, readily portable, light in weight, and easily adapted to a number of lifting or supporting functions. The scaffold sections are modular so that scaffolding of a desired height can be easily assembled. Two or more scaffold units can be used together with one or more horizontal supports disposed between lower platform 35 or upper auxiliary platform 49 to support heavy loads. The scaffold unit of the present invention is free-standing when used in conjunction with a removable base member. Auxiliary braces allow the scaffold unit of the present invention to be used as a portable lift with a farm vehicle or truck. The position of the platforms is readily adjusted by a simple, repositionable hoist unit.

While the scaffold and lift assembly of the present invention has been described in considerable detail, it is understood that various changes and modifications would occur to one of ordinary skill in the art without departing from the spirit and scope of the appended claims.

What is claimed is:

1. A self-contained scaffold assembly, comprising:

first and second pairs of parallel, spaced-apart vertical support members, said vertical support members being joined by a plurality of horizontal spaced-apart side braces, said first and second pairs of support members joined together by a plurality of horizontal, spaced-apart rear braces, said scaffold assembly being open at the front and forming a generally U-shaped cross-section;

a movable carriage unit having spaced-apart side vertical runners and connected by horizontal brace means and at least a pair of rollers on each side runner attached thereto, each said roller captured between and engaging both members of said pair of vertical support members, said carriage unit arranged for vertical movement within the confines of and with respect to said vertical support members;

platform means to support a work load attached to said carriage unit; and hoist means, attached to said carriage unit, for controllably positioning said platform means with respect to said vertical support members.

2. The scaffold assembly of claim 1 wherein each said support member comprises an elongated rail, each said rail having a circular cross-section.

3. The scaffold assembly of claim 1 including a horizontal base assembly, and means to removably attach the base assembly to a lower portion of said pairs of vertical support members, for supporting said scaffold assembly in an erect and free-standing manner.

4. The scaffold assembly of claim 3 wherein said base assembly further includes wheels to enable said scaffold

5. The scaffold assembly of claim 1 wherein said support members are arranged in modular, interlocking sections, whereby a scaffold of desired height is formed.

6. The scaffold assembly of claim 5 wherein said modular support sections interlock by means of interfitting tubular sections formed in said support members, said modular support sections rigidly secured together by bolts disposed through facing plates attached adjacent each said interlocking support section.

7. The scaffold assembly of claim 1 further including auxiliary bracing means to brace and support said scaffold unit.

8. The scaffold assembly of claim 1 including a removable cap piece fitted over the upper ends of said vertical support members.

9. The scaffold assembly of claim 8 wherein said removable cap piece includes a pulley attached thereto, and wherein said hoist means comprises a winch assembly having a cable secured between said carriage unit and said winch assembly, said cable passing around said pulley of said cap piece.

10. A self-contained scaffold assembly, comprising:

first and second pairs of parallel, spaced-apart vertical support members, said first and second pairs of support members joined together by a plurality of horizontal spaced-apart rear braces;

a movable carriage unit having at least a pair of rollers attached thereto, each said roller captured between and engaging both members of said pair of vertical support members, said carriage unit arranged for vertical movement with respect to said vertical support members;

said carriage unit further including a pair of spaced-apart vertical side runners joined by one or more horizontal braces, each said runner including a pair of rollers captured between and engaging both members of said pair of vertical support members;

platform means to support a work load attached to said carriage unit;

said platform means including a primary load-bearing platform removably attached to a lower portion of said pair of runners and an auxiliary load-bearing platform removably attached to an upper portion of said pair of runners; and hoist means, attached to said carriage unit, for controllably positioning said platform means with respect to said vertical support members.

* * * * *